US009758992B2

(12) United States Patent
Kouzuma

(10) Patent No.: US 9,758,992 B2
(45) Date of Patent: Sep. 12, 2017

(54) DOOR LOCK DEVICE FOR VEHICLE

(75) Inventor: Hiroyuki Kouzuma, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 811 days.

(21) Appl. No.: 13/389,699

(22) PCT Filed: Apr. 15, 2011

(86) PCT No.: PCT/JP2011/059363
§ 371 (c)(1),
(2), (4) Date: Feb. 9, 2012

(87) PCT Pub. No.: WO2012/017715
PCT Pub. Date: Feb. 9, 2012

(65) Prior Publication Data

US 2012/0139269 A1 Jun. 7, 2012

(30) Foreign Application Priority Data

Aug. 2, 2010 (JP) ..... 2010-173970

(51) Int. Cl.
*E05C 3/06* (2006.01)
*E05B 81/14* (2014.01)
(Continued)

(52) U.S. Cl.
CPC ..... *E05B 81/14* (2013.01); *E05B 79/20* (2013.01); *E05B 19/0082* (2013.01); *E05B 81/90* (2013.01); *Y10T 292/1075* (2015.04)

(58) Field of Classification Search
CPC ..... E05B 81/90; E05B 81/14; E05B 79/20; E05B 19/0082
(Continued)

(56) References Cited

U.S. PATENT DOCUMENTS 6,419,286 B1 7/2002 Szablewski
6,520,549 B1 2/2003 Kalsi
(Continued)

FOREIGN PATENT DOCUMENTS

CN 2246698 Y 2/1997
CN 1282399 A 1/2001
(Continued)

OTHER PUBLICATIONS

Extended European search report issued in the corresponding European Patent Application 11814346.0 dated Mar. 21, 2017.

*Primary Examiner* — Alyson M Merlino
(74) *Attorney, Agent, or Firm* — Carrier Blackman & Associates, P.C.; Joseph P. Carrier; Jeffrey T. Gedeon

(57) ABSTRACT

A door lock device for a vehicle is provided in which a lock release member that is operable between an operating position at which the ratchet is operated toward the side on which the ratchet engages with the latch and a standby position at which free pivoting of the ratchet is allowed and that is urged toward the standby position is driven to the operating position by a drive member which engages with the lock release member when an actuator is operated, the door lock device being capable of releasing a locked state of a door by operation of the actuator and also being capable of releasing the locked state of the door by a manual operation, wherein an engagement release mechanism (96) releases engagement of a drive member (67) and a lock release member (66) in response to a manual operation for releasing the locked state of the door being carried out while the drive member (67) is engaged with the lock release member (66). This enables recovery of a state in which a door can be held in a closed state even in a state in which a drive member has stopped at an operating position due to malfunction of an
(Continued)

actuator in a state in which a locked state of the door is released.

2 Claims, 10 Drawing Sheets

(51) Int. Cl.

| | |
|---|---|
| ***E05B 79/20*** | (2014.01) |
| *E05C 3/16* | (2006.01) |
| *E05B 19/00* | (2006.01) |
| *E05B 81/90* | (2014.01) |

(58) Field of Classification Search
USPC ..... 292/201, 216, DIG. 23, DIG. 65, 194, 292/198; 70/237, 238, 239
See application file for complete search history.

(56) References Cited

U.S. PATENT DOCUMENTS

| | | | | |
|---|---|---|---|---|
| 7,014,228 | B2 | 3/2006 | Hirai | |
| 8,141,916 | B2 | 3/2012 | Tomaszewski et al. | |
| 2004/0174022 | A1* | 9/2004 | Inoue | 292/216 |
| 2009/0160198 | A1* | 6/2009 | Yoda | 292/201 |
| 2009/0241617 | A1* | 10/2009 | Takahashi et al. | 70/257 |
| 2009/0243309 | A1* | 10/2009 | Takahashi et al. | 292/201 |

FOREIGN PATENT DOCUMENTS

| | | | |
|---|---|---|---|
| CN | 101184900 | A | 5/2008 |
| GB | 2 339 593 | A | 2/2000 |
| JP | 62-9659 | U | 1/1987 |
| JP | 2004-100225 | A | 4/2004 |
| JP | 2005-213818 | A | 8/2005 |
| JP | 2009-013639 | A | 1/2009 |

* cited by examiner

DOOR LOCK DEVICE FOR VEHICLE

TECHNICAL FIELD

The present invention relates to a door lock device for a vehicle, the door lock device including a latch that engages with a striker on a vehicle body side, that is pivotable in a door-closing direction, and that is pivotingly urged in a door-opening direction, a ratchet that is pivotable between an engagement position at which the ratchet engages with the latch engaged with the striker and an engagement release position at which engagement with the latch is released and that is pivotingly urged toward a side on which the ratchet engages with the latch, a lock release member that is operable between an operating position at which the ratchet is operated toward the engagement release position and a standby position at which pivoting of the ratchet toward the engagement position is allowed and that is urged toward the standby position, an actuator, and a drive member that is operatively connected to the actuator and, when the actuator is operated, engages with the lock release member to thus drive the lock release member from the standby position to the operating position, the door lock device being capable of releasing a locked state of a door by operation of the actuator and also being capable of releasing the locked state of the door by a manual operation.

BACKGROUND ART

A door lock device for a vehicle is already known from Patent Document 1, in which release of a locked state of a door is enabled by operation of a drive member by an actuator, and when release of the locked state of the door cannot be carried out by the actuator because of a flat battery or a malfunction of the actuator such as failure of the actuator, the locked state of the door can be released mechanically by a manual operation using a mechanical key.

Related Art Document

Patent Document

Patent Document 1: Japanese Utility Model Application Laid-open No. 62-9659

SUMMARY OF THE INVENTION

Problems to be Solved by the Invention

However, in the arrangement disclosed in Patent Document 1 above, when the drive member has stopped and cannot be moved due to malfunction of the actuator at the position in which the locked state of the door is released by the actuator, since the locked state of the door remains released, it becomes impossible to hold the door at a closed position.

The present invention has been accomplished in light of such circumstances, and it is an object thereof to provide a door lock device for a vehicle that enables recovery of a state in which a door can be held in a closed state even in a state in which a drive member has stopped at an operating position due to malfunction of an actuator in a state in which a locked state of the door is released.

Means for Solving the Problems

In order to attain the above object, according to a first aspect of the present invention, there is provided a door lock device for a vehicle, the door lock device comprising a latch that engages with a striker on a vehicle body side, that is pivotable in a door-closing direction, and that is pivotingly urged in a door-opening direction, a ratchet that is pivotable between an engagement position at which the ratchet engages with the latch engaged with the striker and an engagement release position at which engagement with the latch is released and that is pivotingly urged toward a side on which the ratchet engages with the latch, a lock release member that is operable between an operating position at which the ratchet is operated toward the engagement release position and a standby position at which pivoting of the ratchet toward the engagement position is allowed and that is urged toward the standby position, an actuator, and a drive member that is operatively connected to the actuator and that, when the actuator is operated, engages with the lock release member to thus drive the lock release member from the standby position to the operating position, the door lock device being capable of releasing a locked state of a door by operation of the actuator and also being capable of releasing the locked state of the door by a manual operation, characterized in that the door lock device comprises an engagement release mechanism that releases engagement of the drive member and the lock release member in response to a manual operation for releasing the locked state of the door being carried out while the drive member is engaged with the lock release member.

A front side door 11 of an embodiment corresponds to the door of the present invention, and a first lock release member 66 of the embodiment corresponds to the lock release member of the present invention.

Effects of the Invention

In accordance with the above-mentioned arrangement of the present invention, when an attempt to release the locked state of the door by a manual operation is made, since the engaged state of the drive member and the lock release member is forcibly released by the engagement release mechanism, even if the drive member has stopped and cannot be moved due to malfunction of the actuator while the locked state of the door is released, due to the engaged state of the drive member and the lock release member being released by the manual operation, the lock release member urged toward the standby position can move toward the standby position by releasing the engagement with the drive member, and an original state in which the locked state of the door is held by engaging the ratchet with the latch with which the striker is engaged can be recovered.

EXPLANATION OF REFERENCE NUMERALS AND SYMBOLS

Figure 1:
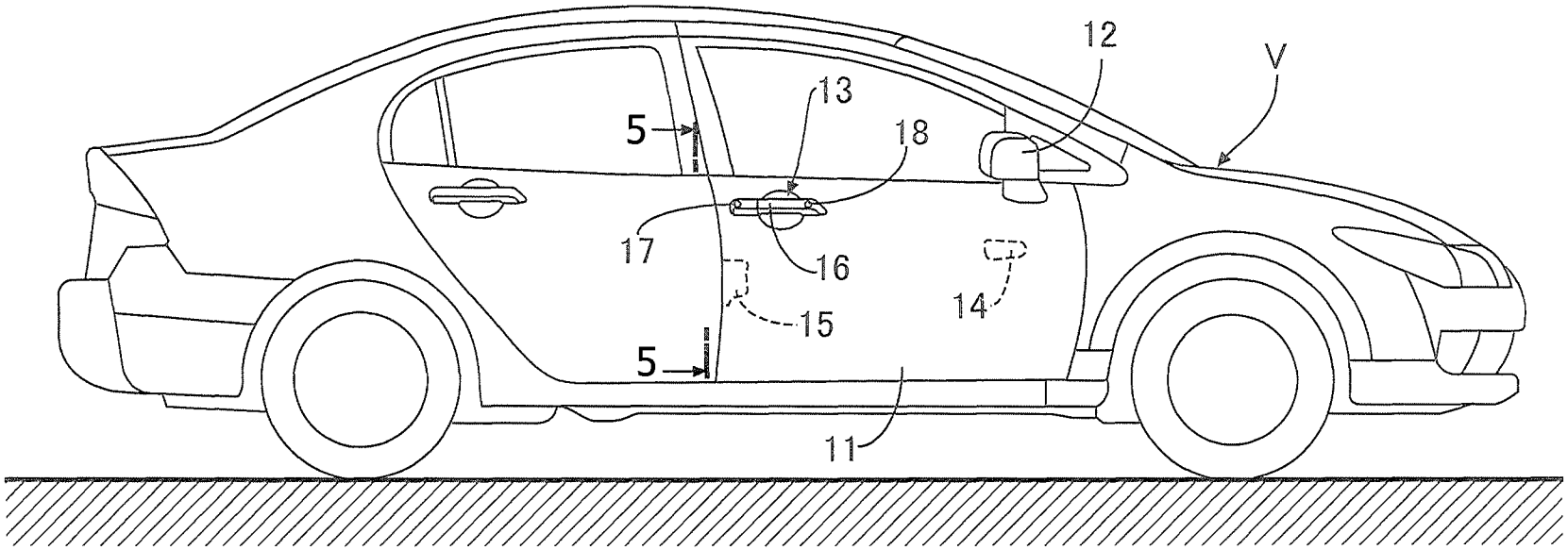
FIG. 1 is a right side view of a passenger vehicle. (first embodiment)

11 Front side door, which is a door
29 Actuator
49 Striker
51 Latch
52 Ratchet
66 First lock release member, which is a lock release member
67 Drive member
96 Engagement release mechanism

MODE FOR CARRYING OUT THE INVENTION

A mode for carrying out the present invention is explained below by reference to the attached FIG. 1 to FIG. 11. First, in FIG. 1, disposed on the outside of, for example, a front side door 11 of this passenger vehicle are a door mirror 12 and also an outer handle unit 13 having an outer handle 16 and a key cylinder 17, and disposed on the inside of the front side door 11 is an inner handle unit 14 that can be operated by a vehicle driver within a vehicle compartment. Also provided on the front side door 11 is a door lock device 15 that can switch between a locked state in which a closed state of the door 11 is held and an unlocked state in which an operation of opening the front side door 11 can be carried out.

Figure 2:
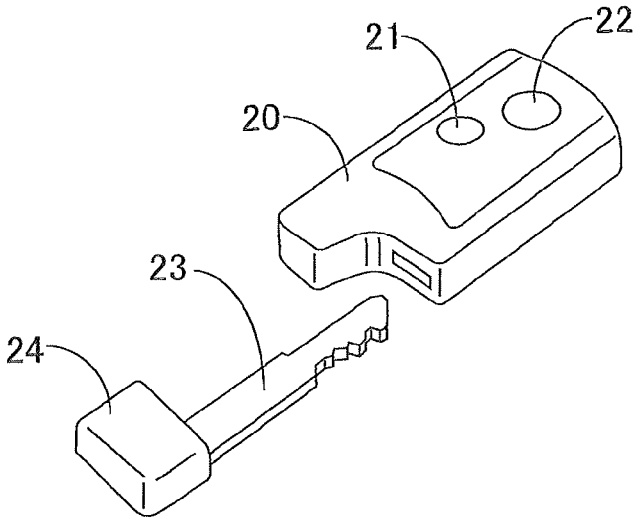
FIG. 2 is an exploded perspective view of a portable apparatus and a mechanical key for an emergency. (first embodiment)

When switching between the locked state and the unlocked state of the door lock device 15 by an operation outside the passenger vehicle V, it is possible to use a portable apparatus 20 shown in FIG. 2. Provided on the portable apparatus 20 are a lock release button 21 and a locking button 22, and disposed on the outer handle 16 is a sensor (not illustrated) that detects, after a user holding a legitimate portable apparatus 20 pushes the lock release button 21, that the outer handle 16 is being gripped and that then outputs a signal for switching the door lock device 15 from the locked state to the unlocked state, or a first open switch 18 that is operated by a user in order to give an instruction to release the lock.

It is also possible to switch between the locked state and the unlocked state of the door lock device 15 using a portable electronic key, which is not illustrated, and the outer handle 16 may be provided with a sensor (not illustrated) that detects that the outer handle 16 is being gripped by a user holding a legitimate portable electronic key and then outputs a signal for switching the door lock device 15 from the locked state to the unlocked state, or a first open switch 18 that outputs a signal for switching the door lock device 15 from the locked state to the unlocked state by being operated by a user holding a legitimate portable electronic key.

Furthermore, a mechanical key 23 having a grip part 24 is attached to the portable apparatus 20 for use in an emergency such as a battery being flat, and when the mechanical key 23 is not in use it is housed within the portable apparatus 20 with only the grip part 24 projecting. It is thus possible to insert the mechanical key 23 into the key cylinder 17 of the outer handle unit 13 and switch between the locked state and the unlocked state of the door lock device 15 by a manual operation.

Figure 3:
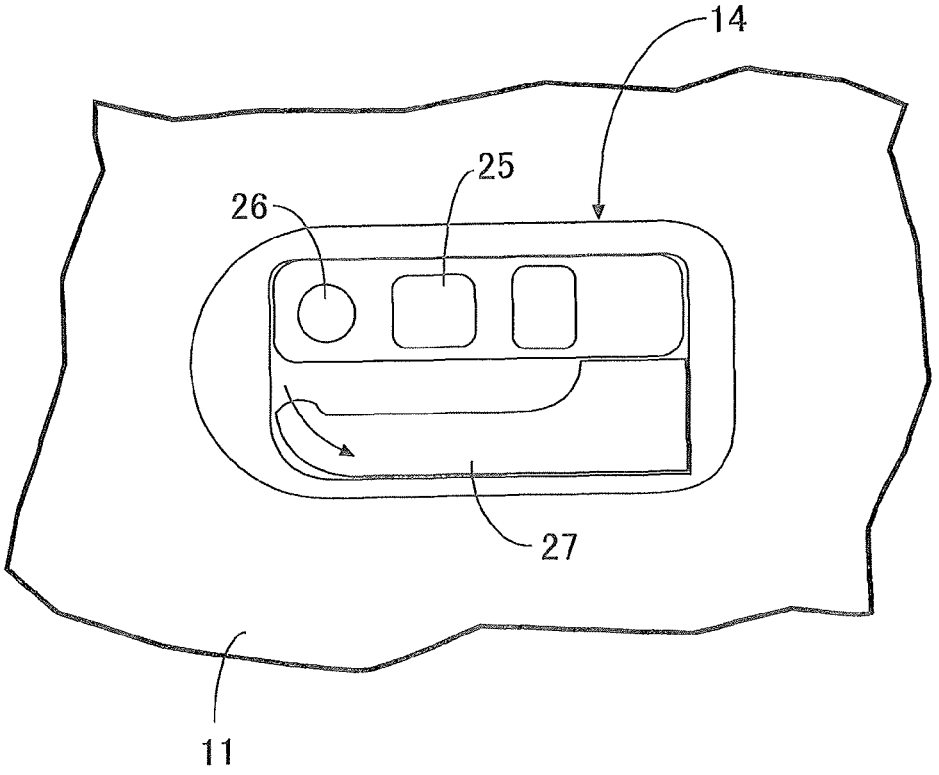
FIG. 3 is a view of an inner handle unit from a vehicle compartment side. (first embodiment)

In FIG. 3, the inner handle unit 14 includes a lock/unlock switchover switch 25 for giving an instruction to switch the door lock device 15 between the unlocked state and the locked state, a locked state display LED 26 that is lit when the door lock device 15 is in the locked state, and an inner handle 27 that can be pivoted by the vehicle driver within the vehicle compartment.

The operating force of the inner handle 27 is transmitted to the door lock device 15 side via a cable 30 (see FIG. 6); when the inner handle 27 is pivoted to a slight degree, a second open switch 28 (see FIG. 4 and FIG. 6) installed within the door lock device 15 attains an ON state, and when the inner handle 27 is pivoted to a large degree, it is possible to switch the door lock device 15 in the locked state to the unlocked state. That is, the door lock device 15 in the locked state is mechanically switched from the locked state to the unlocked state by means of a manual operation using the mechanical key 23 inserted into the key cylinder 17 or a manual operation of pivoting the inner handle 27 to a large degree.

Figure 4:
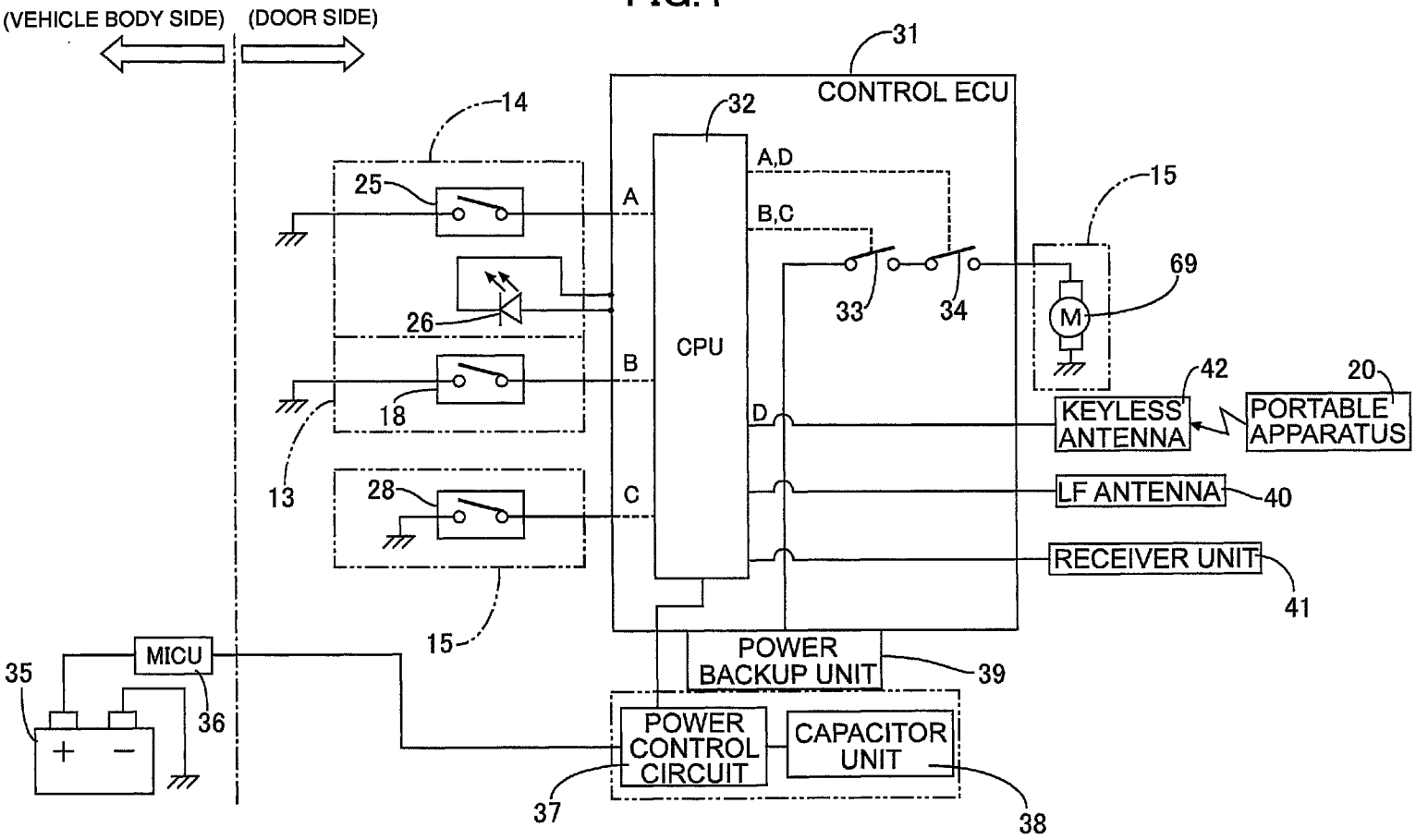
FIG. 4 is a block diagram showing the arrangement of an electrical control system related to a door lock device. (first embodiment)

In FIG. 4, installed within the door lock device 15 are an actuator 29 and also the second open switch 28, the actuator 29 operating the door lock device 15 according to a lock release instruction operation by the first open switch 18 or the second open switch 28 so as to put the front side door 11 in an openable state.

Provided within the front side door 11 is a control ECU 31 for controlling operation of an electric motor 69 of the actuator 29, the control ECU 31 including a CPU 32 and first and second switches 33 and 34 connected in series to the electric motor 69 of the door lock device 15.

The control ECU 31 is equipped with a capacitor unit 38 connected, via an MICU (Multiplex Integrated Control Unit) 36 and a power control circuit 37, to a battery 35 mounted on the vehicle body, and this capacitor unit 38 is connected to the series circuit formed from the first and second switches 33 and 34 via a power backup unit 39.

Furthermore, inputted into the CPU 32 are signals from an LF antenna 40 and a receiver unit 41 used for transfer of an ID signal between themselves and the portable apparatus 20, and a signal from a keyless antenna 42 that receives a signal outputted via wireless communication from the portable apparatus 20 in response to operation of the lock release button 21 of the portable apparatus 20.

Signals from the lock/unlock switchover switch 25, the first open switch 18, the second open switch 28, and the keyless antenna 42 are inputted into the CPU 32 as shown by reference symbols A, B, C, and D in FIG. 4, and the CPU 32 provides ON/OFF control of the first and second switches 33 and 34 according to signals input from lock/unlock switchover switch 25, the first open switch 18, the second open switch 28, and the keyless antenna 42.

The reference symbols A to D illustrated in FIG. 4 with respect to the first and second switches 33 and 34 correspond to the reference symbols A to D assigned to signals inputted from the lock/unlock switchover switch 25, the first open switch 18, the second open switch 28, and the keyless antenna 42 to the CPU 29; when the lock/unlock switchover switch 25 is ON the CPU 32 puts the second switch 34 into an ON state, when the first open switch 18 is ON the CPU 32 puts the first switch 33 into an ON state, when the second open switch 28 is ON the CPU 32 puts the first switch 33 into an ON state, and the CPU 32 puts the second switch 34 into an ON state according to the signal input from the keyless antenna 42 in response to operation of the lock release button 21 of the portable apparatus 20.

Due to the second switch 34 attaining the ON state when the lock/unlock switchover switch 25 is ON or when there is signal input from the keyless antenna 42 in response to operation of the lock release button 21 of the portable apparatus 20, a state is attained in which release of a locked state of the door lock device 15 is allowed, and due to the first open switch 18 or the second open switch 28 attaining the ON state in this state, the electric motor 69 operates only for a predetermined time and the door lock device 15 attains an unlocked state.

Figure 5:
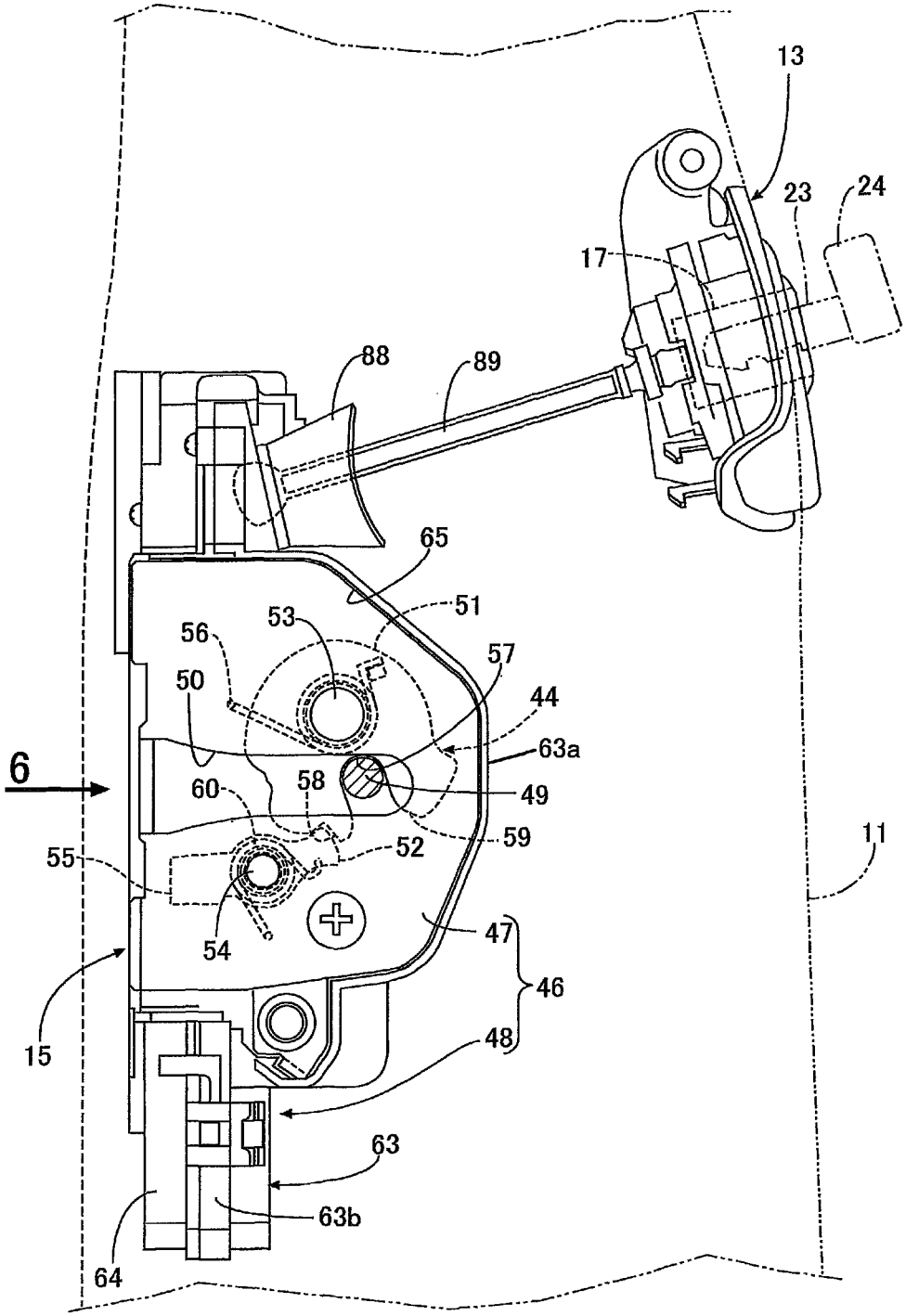
FIG. 5 is a view of a key cylinder and the door lock device from arrowed line 5-5 in FIG. 1. (first embodiment)
Figure 6:
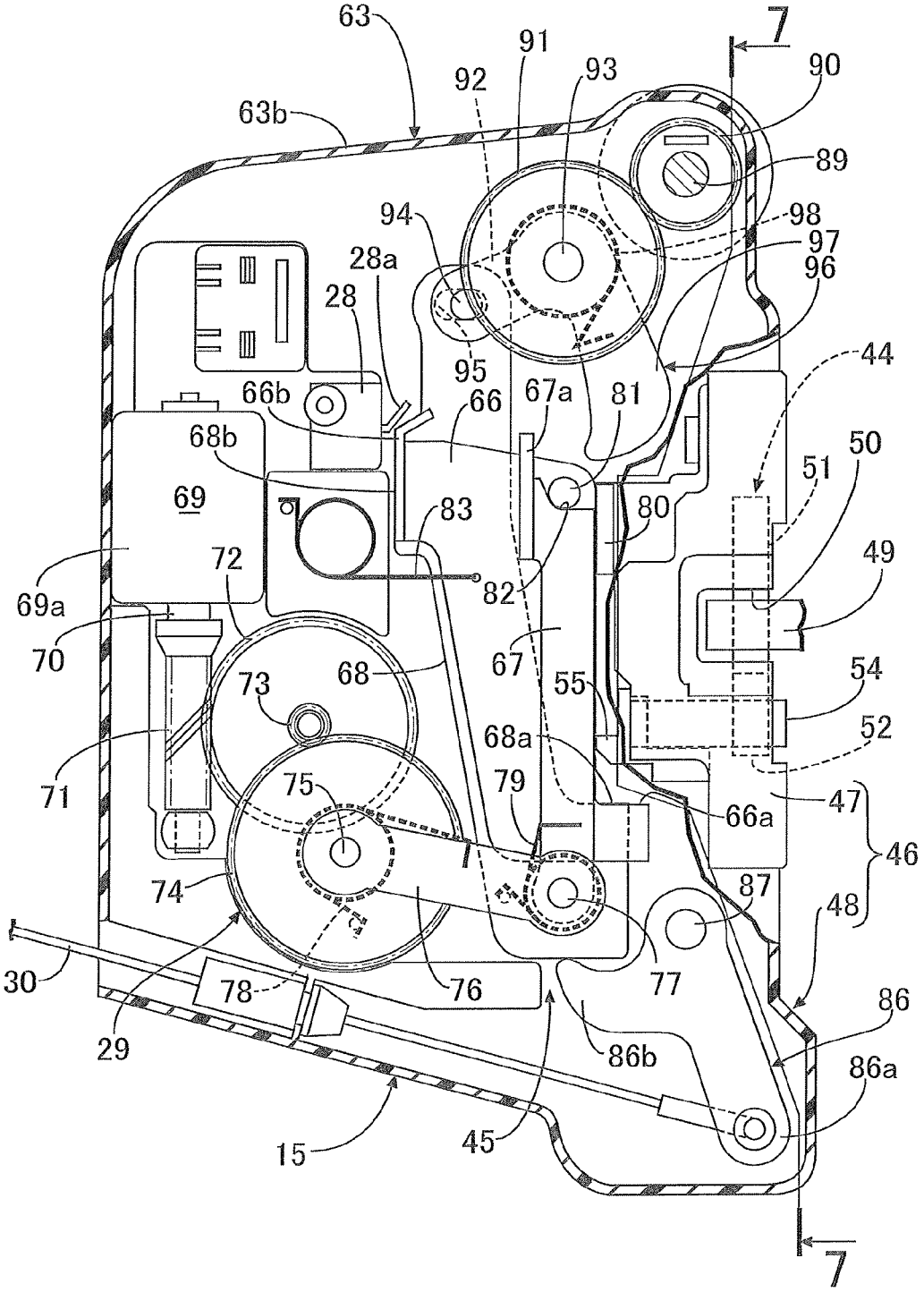
FIG. 6 is a partially cutaway side view of the door lock device from arrowed direction 6 in FIG. 5. (first embodiment)

In FIG. 5 and FIG. 6, the door lock device 15 includes a latch mechanism 44 that switches between the locked state in which opening of the front side door 11 is disabled and the unlocked state in which opening of the front side door 11 is enabled, and a lock/unlock switching mechanism 45 that switches between a locked state and an unlocked state of the latch mechanism 44, a casing 46 of this door lock device 15 being formed by mounting a first case 47 housing the latch mechanism 44 on a second case 48 housing the lock/unlock switching mechanism 45.

The first case 47 is provided with an approach groove 50 that allows a striker 49 fixed to the vehicle body side to enter, and the latch mechanism 44 includes a latch 51 that can pivot in a door-closing direction (anticlockwise direction in FIG. 5) by engagement with the striker 49 entering the approach groove 50, and a ratchet 52 that can engage with the latch 51 so as to hold the pivot position of the latch 51.

The latch 51, which is housed within the first case 47, is pivotably supported by a support shaft 53 provided on the first case 47 above the approach groove 50. Furthermore, a first pivot shaft 54 having an axis parallel to the support shaft 53 is supported on the first case 47 beneath the approach groove 50 so as to pivot around the axis, and the ratchet 52, which is housed within the first case 47, is fixed to the first pivot shaft 54.

Figure 7:
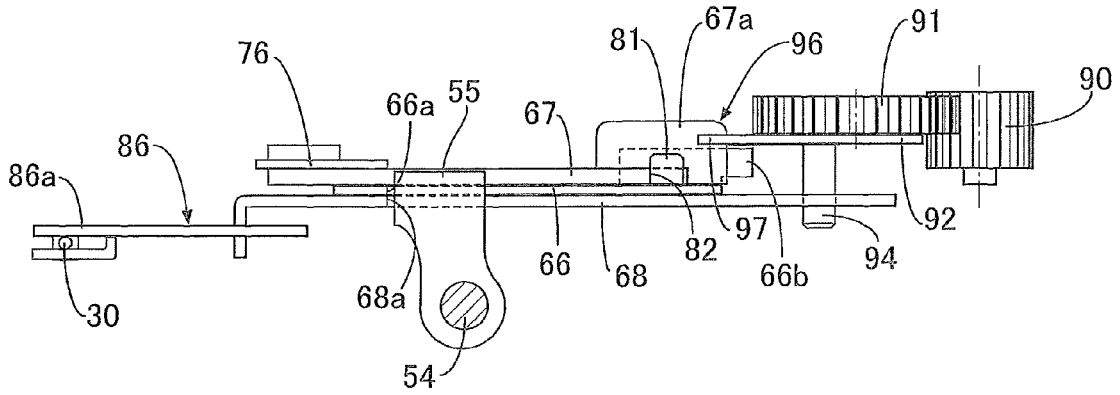
FIG. 7 is a sectional view along line 7-7 in FIG. 6. (first embodiment)

Referring in addition to FIG. 7, a ratchet lever 55 is fixed to an end part the first pivot shaft 54 projecting from the first case 47 toward the second case 48 side, and this ratchet lever 55 pivots together with the ratchet 52. That is, the latch 51 is pivotably supported by the support shaft 53 above the approach groove 50, whereas the ratchet 52 and the ratchet lever 55, which pivot as a unit, are fixed to the first pivot shaft 54 beneath the approach groove 50 so that the approach groove 50 is interposed between themselves and the latch 51.

Provided between the latch 51 and the first case 47 is a first torsion spring 56 surrounding the support shaft 53, the latch 51 being pivotingly urged in a door-opening direction (clockwise direction in FIG. 5) by means of the spring force exhibited by this first torsion spring 56. Provided on an outer peripheral part of the latch 51 are an engagement channel 57 with which the striker 49 entering the approach groove 50 when the latch 51 is at the end of pivoting in the door-opening direction engages, a full engagement step 58, and a half engagement step 59.

The ratchet 52 can pivot between an engagement position (position shown in FIG. 5) in which it engages with the full engagement step 58 and the half engagement step 59 of the latch 51 in a state in which the latch 51 is engaged with the striker 49 and an engagement release position in which engagement with the latch 51 is released by pivoting from the engagement position in a clockwise direction in FIG. 5, and is pivotably urged toward the side on which it is engaged with the latch 51, that is, the engagement position side, by means of a second torsion spring 60 provided between the first case 47 and the ratchet 52 so as to surround the first pivot shaft 54.

When the latch 51 is at the end of pivoting in the door-opening direction, the outer periphery of the ratchet 52 is in contact with the outer periphery of the half engagement step 59 of the latch 51, and when the latch 51 pivots in a door-closing direction (anticlockwise direction in FIG. 5) by being pushed by the striker 49 entering the approach groove 50, the striker 49 is engaged with the engagement channel 57 and the contact position of the ratchet 52 changes from the outer periphery of the half engagement step 59 to the outer periphery of the full engagement step 58. In this process, a half shut state of the front side door 11 is held by the ratchet 52 engaging with the half engagement step 59. Furthermore, if the latch 51 pivots further in the door-closing direction in response to the striker 49 engaged with the engagement channel 57 advancing further inward within the approach groove 50, the ratchet 52 engages with the full engagement step 58 and the front side door 11 is locked in a fully door-closed state.

A lock release operation force can be inputted into the ratchet lever 55, and in response to the lock release operation force being inputted into the ratchet lever 55 the ratchet lever 55 and the ratchet 52 pivot in the clockwise direction in FIG. 5, engagement of the ratchet 52 with the latch 51 is thereby released, a locked state of the latch mechanism 44 in which the front side door 11 is locked in the fully door-closed state is released, and the latch mechanism 44 attains an unlocked state.

The second case 48 housing the lock/unlock switching mechanism 45 is formed by joining to each other a housing case 63 made of a synthetic resin and a cover 64 made of a synthetic resin. The housing case 63 has a substantially L-shaped form integrally having a latch mechanism housing portion 63*a* formed by forming a housing recess 65, which houses the first case 47, into a box shape and a lock/unlock switching mechanism housing portion 63*b*, which rises from the latch mechanism housing portion 63*a* so as to house the lock/unlock switching mechanism 45, and the cover 64 is joined to the housing case 63 so as to cover the lock/unlock switching mechanism housing portion 63*b* of the housing case 63.

The lock/unlock switching mechanism 45 includes the actuator 29, a first lock release member 66, a drive member 67, and a second lock release member 68, the first lock release member 66 being capable of operating between an operating position in which the ratchet 52 pivotingly urged toward the side on which it engages with the latch 51 is operated toward an engagement release position side on which engagement with the latch 51 is released and a standby position in which free pivoting of the ratchet 52 is allowed, the first lock release member 66 being urged toward the standby position side, the drive member 67 being operatively connected to the electric motor 69 and, when the electric motor 69 is operated, engaging with the first lock release member 66 so as to drive the first lock release member 66 from the standby position toward the operating position side, and the second lock release member 68 being operated by manual operation using the mechanical key 23 or a manual operation that pivots the inner handle 27 to a large degree and operating the ratchet 52 toward the engagement release position side on which engagement with the latch 51 is released. In the same manner as for the first lock release member 66 the second lock release member 68 can also operate between an operating position in which the ratchet 52 is operated toward an engagement release position side that releases engagement with the latch 51 and a standby position in which free pivoting of the ratchet 52 is allowed, and is urged toward the standby position side.

The first lock release member 66, the drive member 67, and the second lock release member 68 are formed into a flat plate shape extending lengthwise in the vertical direction with one end in the longitudinal direction as a lower end and, as is clearly shown in FIG. 7, are superimposed on one another so that the first lock release member 66 is interposed between the drive member 67 and the second lock release member 68.

The first and second lock release members 66 and 68 are provided with abutment portions 66*a* and 68*a* that can abut against the ratchet lever 55 from below; when the first and second lock release members 66 and 68 are at the standby position shown in FIG. 7 the abutment portions 66*a* and 68*a* oppose the ratchet lever 55 from below, and when the first lock release member 66 or the second lock release member 68 operates from the standby position to the operating position, which is above the standby position, the abutment portion 66*a* or the abutment portion 68*a* abuts against the ratchet lever 55 so as to pivot the ratchet lever 55 and the ratchet 52 toward the engagement release position side.

The actuator 29 includes the electric motor 69 housed within and fixed to the second case 48 of the casing 46 while having its rotational axis in the vertical direction, a worm wheel 71 provided coaxially on a motor shaft 70 extending downward from a motor case 69*a* of the electric motor 69, a worm gear 72 rotatably supported by the second case 48 and meshing with the worm wheel 71, an idle gear 73 rotating together with the worm gear 72, a driven gear 74 secured to a second pivot shaft 75 pivotably supported by the second case 48 and meshing with the idle gear 73, and a lever 76 having one end part secured to the second pivot shaft 75, one end part (lower end part) of the drive member 67 being pivotably linked to the other end part of the lever 76 via a first link pin 77.

A third torsion spring 78 surrounding the second pivot shaft 75 is provided between the lever 76 and the lock/unlock switching mechanism housing portion 63*b* of the housing case 63 of the second case 48, the lever 76 being pivotingly urged in the clockwise direction in FIG. 6 by means of the spring force of the third torsion spring 78. Due to operation of the electric motor 69, the lever 76 pivots in the anticlockwise direction in FIG. 6 against the spring force of the third torsion spring 78, and the drive member 67 is thereby operated upward.

A fourth torsion spring 79 surrounding the first link pin 77 is provided between the lever 76 and the drive member 67, the drive member 67 being pivotingly urged in the clockwise direction in FIG. 6 by means of the spring force of the fourth torsion spring 79. On the other hand, a guide part 80 is projectingly provided integrally with the lock/unlock switching mechanism housing portion 63*b* of the housing case 63 of the second case 48 so as to guide movement, in the vertical direction, of the drive member 67, the guide part 80 abutting against a side face of the drive member 67 so as to restrict the end of pivoting of the drive member 67 in the direction in which it is pivotingly urged by the fourth torsion spring 79.

Figure 8:
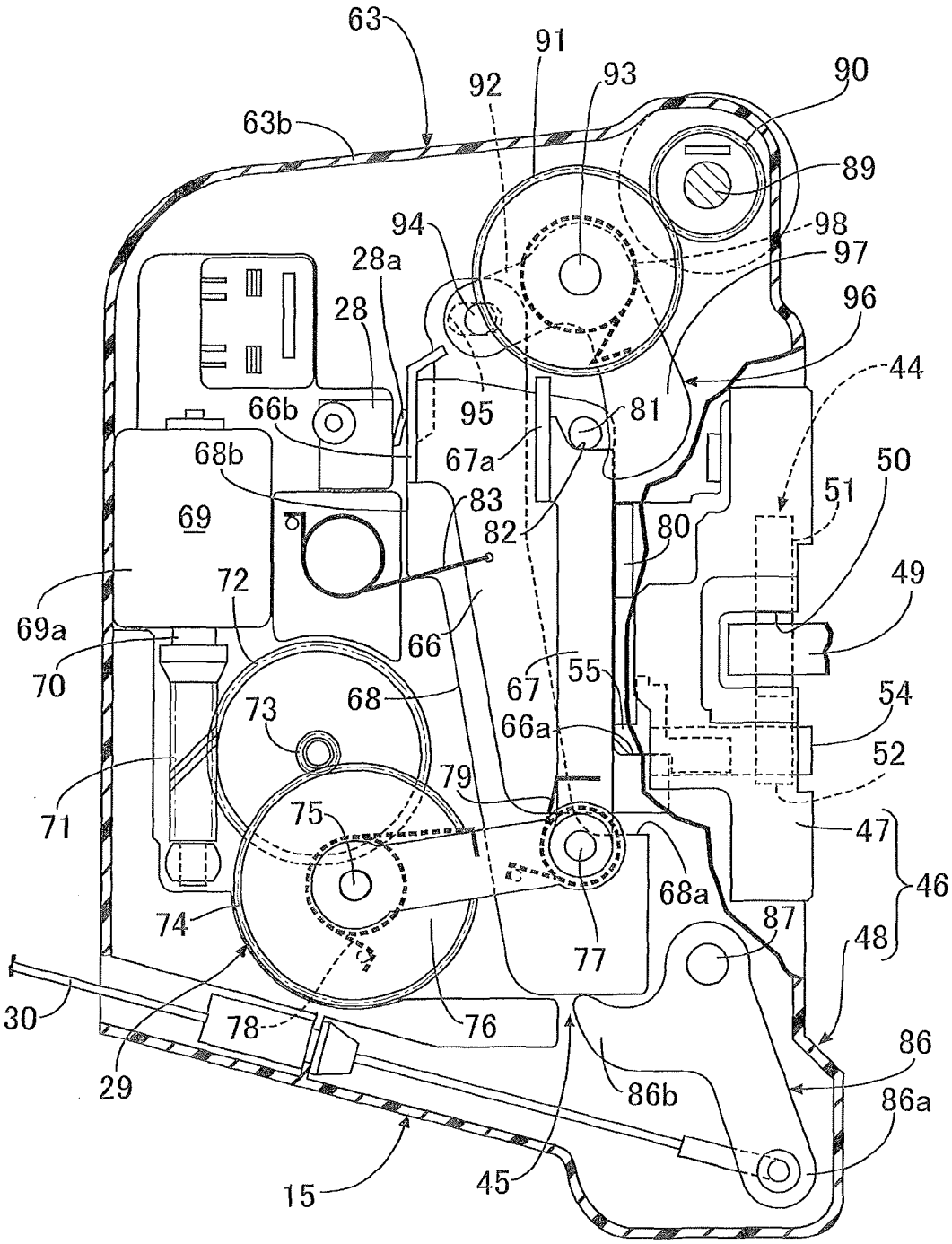
FIG. 8 is a partially cutaway side view, corresponding to FIG. 6, in a state in which a first lock release member has been moved to an operating position by means of an electric motor. (first embodiment)

A pin 81 is implanted in an upper end part (other end part) of the first lock release member 66, and an engagement face 82 that can abut against and engage with the pin 81 from below is formed in an upper end part (other end part) of the drive member 67. When the drive member 67 operates upward due to operation of the electric motor 69, as shown in FIG. 8 the engagement face 82 engages with the pin 81 and pushes the first lock release member 66 upward, the first lock release member 66 having the abutment portion 66*a* abutting against the ratchet lever 55 is driven from the standby position to the operating position by means of the drive member 67, and the ratchet 52 pivoting together with the ratchet lever 55 pivots toward the engagement release position side on which engagement with the latch 51 is released.

Furthermore, a fifth torsion spring 83 is provided between the first lock release member 66 and the lock/unlock switching mechanism housing portion 63*b* of the housing case 63 of the second case 48, the first lock release member 66 being urged in the direction in which the pin 81 is abutted against the engagement face 82 from above, that is, toward the side on which it returns from the operating position to the standby position.

Moreover, an upper end part of the first lock release member 66 is provided with a switch abutment portion 66*b* that abuts against a detector 28*a* of the second open switch 28 fixedly disposed on the lock/unlock switching mechanism housing portion 63*b* of the housing case 63 of the second case 48 when the first lock release member 66 moves to the operating position, and movement of the first lock release member 66 to the operating position is detected by the second open switch 28. A state in which the drive member 67 has stopped and cannot be moved due to malfunction of the actuator 29 at a position in which the locked state of the front side door 11 is released by the actuator 29 can be determined by a long duration of a state in which the first lock member 66 is detected by the second open switch 28, and a user is informed of this state by means of an indicator lamp, etc.

The cable 30, which transmits the operating force of the inner handle 27 of the inner handle unit 14, is linked to a first open lever 86 pivotably supported on the second case 48 of the casing 46 so as to be positioned beneath the second lock release member 68.

This first open lever 86 integrally has a lever main portion 86*a* and an engagement arm portion 86*b*, the lever main portion 86*a* having one end part pivotably supported on the second case 48 via a shaft 87 and the other end part linked to the cable 30, and the engagement arm portion 86*b* being provided so as to be connected to the one end part of the lever main portion 86*a* so that it can engage with a lower end part of the second lock release member 68 from below. When the cable 30 is pulled in response to pivoting of the inner handle 27, the first open lever 86 pivots in the clockwise direction in FIG. 7 and FIG. 8 and the second lock release member 68 is driven upward from the standby position by being pushed upward by the engagement arm portion 86*b*.

Figure 9:
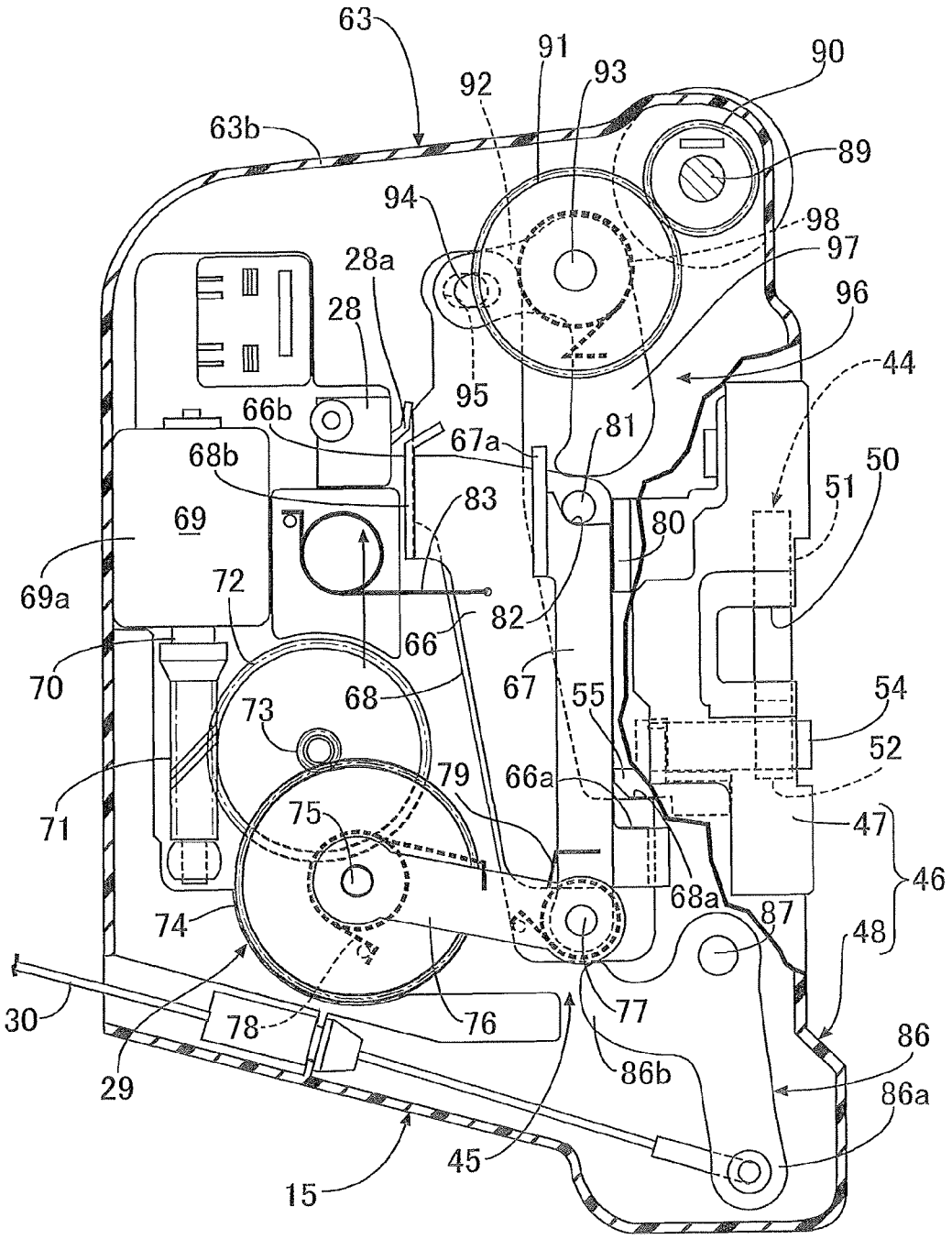
FIG. 9 is a partially cutaway side view, corresponding to FIG. 6, in a state in which an inner handle has been operated to a slight degree. (first embodiment)

A switch abutment portion 68*b* is provided on an upper end part of the second lock release member 68, the switch abutment portion 68*b* abutting against the detector 28*a* of the second open switch 28 as shown in FIG. 9 when the second lock release member 68 moves upward from the standby position in response to a slight pivoting operation of the inner handle 27, and the second open switch 28 detects a slight pivoting operation of the inner handle 27. In response to the second open switch 28 detecting a slight pivoting operation of the inner handle 27, the electric motor 69 operates, as shown in FIG. 8 the drive member 67 operates upward, the engagement face 82 engages with the pin 81 to thus make the first lock release member 66 be pushed upward and be driven from the standby position to the operating position, and the ratchet 52 pivots toward the engagement release position side on which engagement with the latch 51 is released.

As shown in FIG. 5, a guide tube 88 is provided in an upper part of the lock/unlock switching mechanism housing portion 63*b* of the housing case 63 of the second case 48, the guide tube 88 projecting toward the key cylinder 17 of the outer handle unit 13, and a pivot rod 89 is inserted into the guide tube 88, the pivot rod 89 transmitting a pivoting force from the key cylinder 17 accompanying operation of the mechanical key 23. This pivot rod 89 is linked relatively non-pivotably to a drive gear 90 housed within the second case 48, and a second open lever 92 rotates together with a driven gear 91 meshing with this drive gear 90.

One end part of the second open lever 92 and the driven gear 91 are secured to a third pivot shaft 93 pivotably supported by the second case 48, and a second link pin 94 implanted in the other end part of the second open lever 92 is inserted through and linked to an elongated hole-shaped link hole 95 provided in the upper end part of the second lock release member 68.

Therefore, when the key cylinder 17 is manually operated using the mechanical key 23, the second open lever 92 pivots in the clockwise direction in FIG. 6, the second lock release member 68 is driven from the standby position to the operating position, and the ratchet 52 pivots toward the engagement release position side on which engagement with the latch 51 is released. Furthermore, when the inner handle 27 is pivoted to a large degree, the second lock release member 68 is driven upward to the operating position by means of the first open lever 86, the ratchet 52 pivots to the engagement release position side on which engagement with the latch 51 is released, and the second open lever 92 pivots in the clockwise direction in FIG. 6.

If, in a state in which the drive member 67 operated by the actuator 29 is engaged with the first lock release member 66 so as to drive it to the operating position and the locked state of the front side door 11 is released, a malfunction occurs in the actuator 29, which includes the transmission motor 69, and the drive member 67 stops moving while the first lock release member 66 is left at the operating position, since the locked state of the front side door 11 remains released, the front side door 11 cannot be held at a closed position. The door lock device 15 therefore includes an engagement release mechanism 96 for releasing engagement of the drive member 67 and the first lock release member 66 in response to a manual operation using the mechanical key 23 or the inner handle 27 for releasing the locked state of the front side door 11 being carried out in a state in which the drive member 67 is engaged with the first lock release member 66.

The engagement release mechanism 96 is formed from an abutment plate portion 67*a* provided in the upper end part of the drive member 67 so as to extend vertically and substantially perpendicular to the engagement face 82 and an engagement release arm 97 provided so as to be connected to one end part of the second open lever 92 while enabling its extremity to abut against the abutment plate portion 67*a*, and a sixth torsion spring 98 for exhibiting a spring force that makes the engagement release arm 97 move away from the abutment plate portion 67*a* is provided between the engagement release arm 97 and the second case 48.

When the drive member 67 having the engagement face 82 abutting against and engaging with the pin 81 from below has driven the first lock release member 66 to the operating position, the engagement release arm 97, which pivots together with the second open lever 92 by means of a manual operation using the mechanical key 23 or the inner handle 27, passes through the pin 81, abuts against the abutment plate portion 67*a*, and is pressed against the abutment plate portion 67*a* toward the side on which it moves away from the pin 81. This enables the drive member 67 to pivot around the axis of the first link pin 77 in the anticlockwise direction in FIG. 8 and abutment and engagement of the engagement face 82 with the pin 81 to be released.

Figure 10:
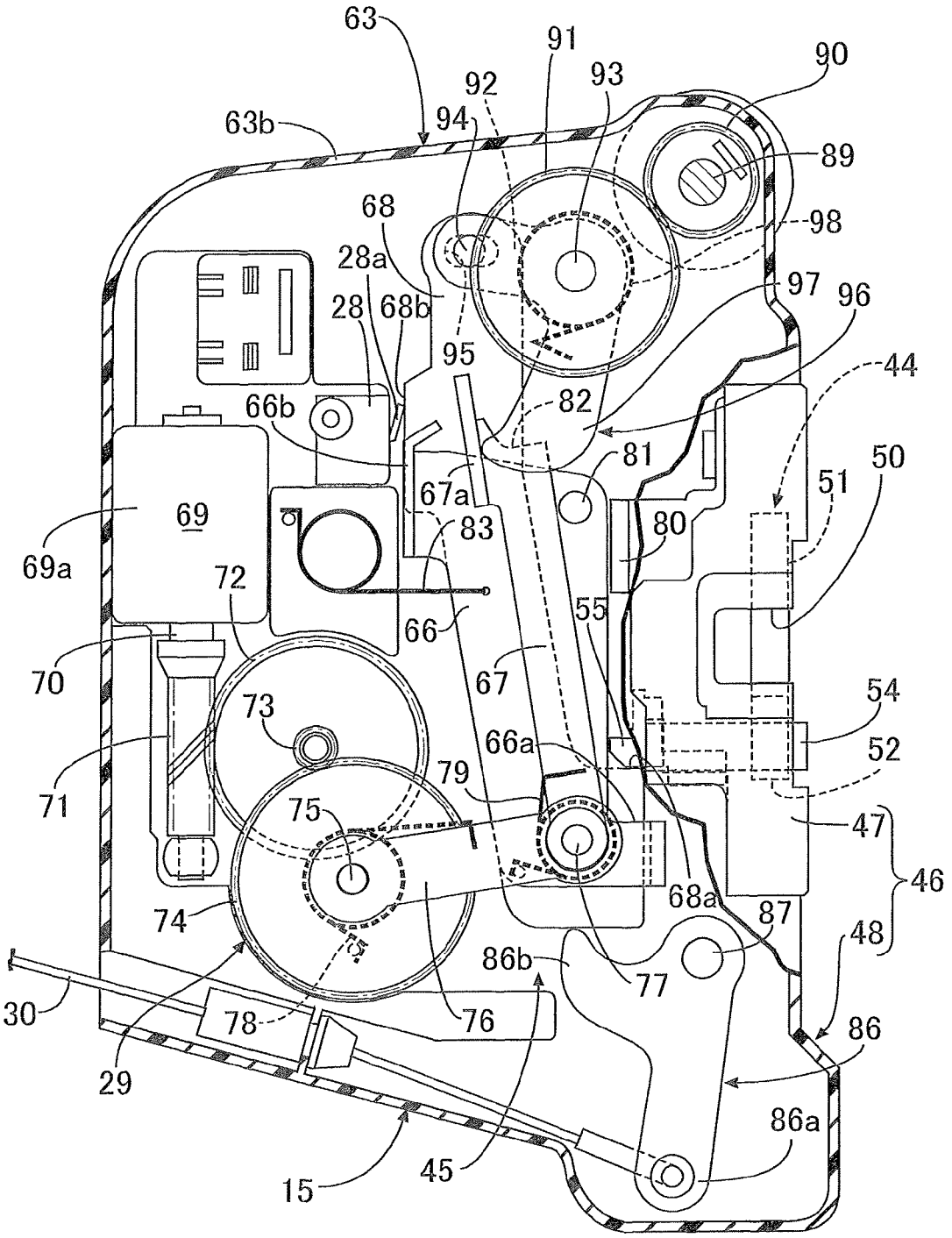
FIG. 10 is a partially cutaway side view, corresponding to FIG. 6, in a state in which the inner handle has been operated to a large degree when the actuator has malfunctioned. (first embodiment)
Figure 11:
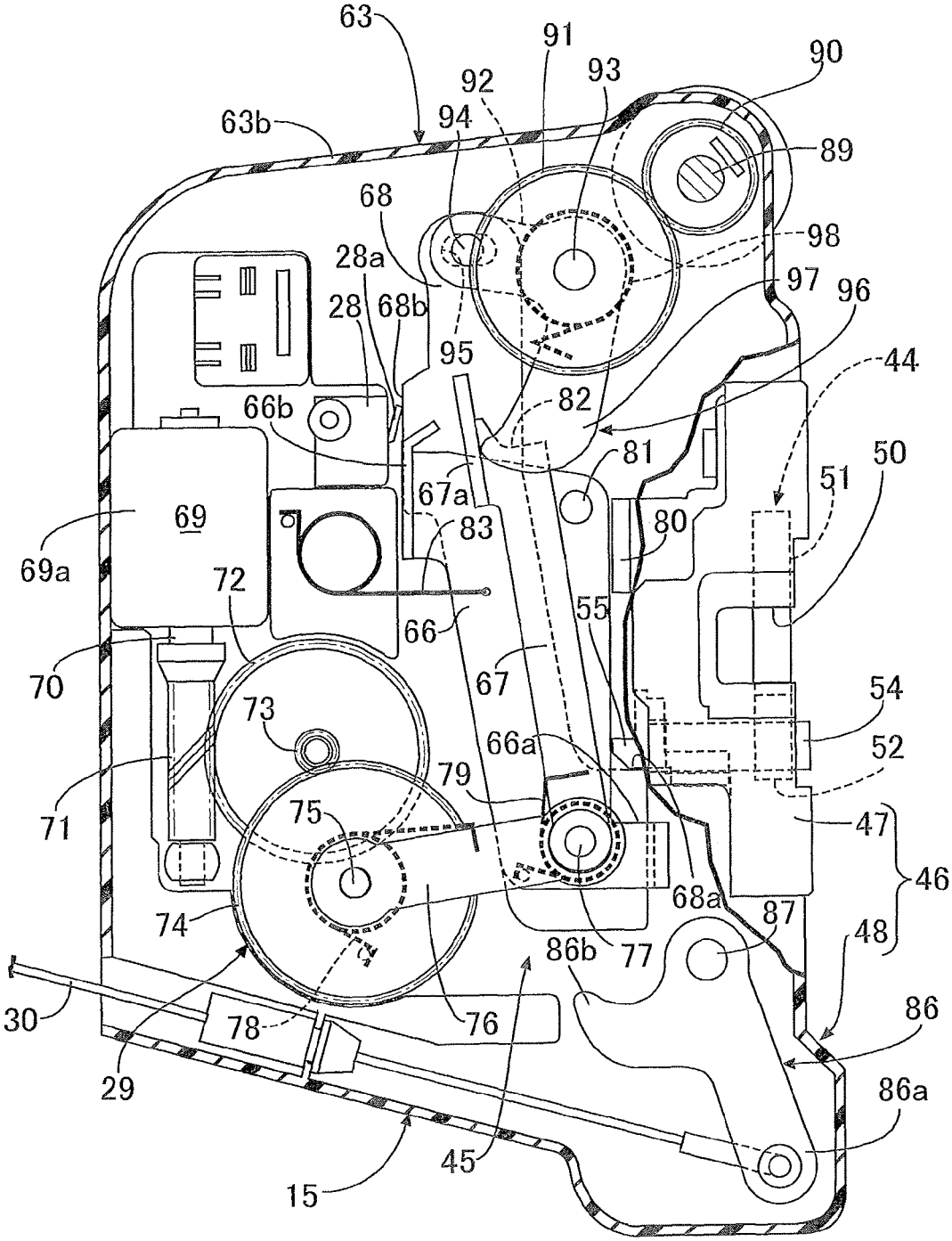
FIG. 11 is a partially cutaway side view, corresponding to FIG. 6, in a state in which a manual operation using a mechanical key has been carried when the actuator has malfunctioned. (first embodiment)

That is, when, in a state in which the drive member 67 has driven the first lock release member 66 to the operating position, a manual operation using the inner handle 27 is carried out, as shown in FIG. 10 the drive member 67 is pivoted toward the side on which abutment and engagement of the engagement face 82 with the pin 81 is released, and the first lock release member 66 is returned toward the standby position side by means of the spring force of the fifth torsion spring 83. Furthermore, when, in a state in which the drive member 67 has driven the first lock release member 66 to the operating position, a manual operation using the mechanical key 23 is carried out, as shown in FIG. 11 the drive member 67 is pivoted toward the side on which abutment and engagement of the engagement face 82 with the pin 81 is released, and the first lock release member 66 is returned toward the standby position side by means of the spring force of the fifth torsion spring 83.

The operation of this embodiment is now explained. Since the door lock device 15 includes the engagement release mechanism 96, which releases engagement of the drive member 67 and the first lock release member 66 in response to a manual operation using the mechanical key 23 or the inner handle 27 for releasing the locked state of the front side door 11 being carried out in a state in which the drive member 67 is engaged with the first lock release member 66, when an attempt to release the locked state of the front side door 11 by a manual operation is made, the state in which the drive member 67 and the first lock release member 66 are engaged is forcibly released by the engagement release mechanism 96, and even if the drive member 67 has stopped and cannot move due to malfunction of the actuator 29 while the locked state of the front side door 11 is released, the first lock release member 66, which is urged toward the standby position side, can be moved toward the standby position side by releasing engagement with the drive member 67, and it is thereby possible to recover the original state in which the ratchet 52 is engaged with the latch 51 having the striker 49 engaged therewith so as to hold a locked state of the front side door 11.

An embodiment of the present invention is explained above, but the present invention is not limited to the above-mentioned embodiment and may be modified in a variety of ways as long as the modifications do not depart from the spirit and scope thereof.

The invention claimed is:

1. A door lock device for a vehicle, comprising:

a latch that selectively engages with a striker on a vehicle body side, that is pivotable in a door-closing direction, that is pivotingly urged in a door-opening direction, and that alternates between an engaged state with the striker in a locked state of a door and a disengaged state with the striker in an unlocked state of the door;

a ratchet that is pivotable between an engagement position at which the ratchet engages with the latch in the engaged state with the striker and an engagement release position at which engagement with the latch is released, thereby releasing the locked state of the door, and that is pivotingly urged toward a side on which the ratchet engages with the latch;

a lock release member that is operable between an operating position at which the ratchet is operated toward the engagement release position and a standby position at which pivoting of the ratchet toward the engagement position is allowed, and that is urged toward the standby position;

an actuator operable to release the locked state of the door;

a drive member that is operatively connected to the actuator and that, when the actuator is operated, engages with the lock release member to thus drive the lock release member from the standby position to the operating position, thereby releasing the locked state of the door, wherein the locked state of the door is also releasable by a first manual operation and a second manual operation;

a pin implanted in an upper end part of the lock release member;

an engagement face formed in an upper end part of the drive member for selectively abutting the pin and thereby providing an engagement of the drive member with the lock release member; and an engagement release mechanism that releases the engagement of the drive member with the lock release member by releasing the abutment of the engagement face with the pin in response to the second manual operation for releasing the locked state of the door being carried out while the drive member is in engagement with the lock release member, wherein the first manual operation for releasing the locked state of the door includes a manual pivoting of an inner handle to a large degree.

2. The door lock device for a vehicle according to claim 1, wherein the engagement release mechanism comprises:

an abutment plate portion provided in the upper end part of the drive member so as to extend vertically and perpendicularly relative to the engagement face; and an engagement release arm provided on an open lever and biased away from abutment with the abutment plate portion, wherein the second manual operation for releasing the locked state of the door includes actuation the open lever to force the engagement release arm into abutment with the abutment plate portion, thereby releasing the engagement of the drive member with the lock release member.

* * * * *